US011045928B2

(12) United States Patent
Peng

(10) Patent No.: US 11,045,928 B2
(45) Date of Patent: Jun. 29, 2021

(54) IMPACT WRENCH

(71) Applicant: Cheng-Chia Peng, Taichung (TW)

(72) Inventor: Cheng-Chia Peng, Taichung (TW)

( * ) Notice: Subject to any disclaimer, the term of this patent is extended or adjusted under 35 U.S.C. 154(b) by 325 days.

(21) Appl. No.: 16/244,238

(22) Filed: Jan. 10, 2019

(65) Prior Publication Data

US 2019/0217453 A1 Jul. 18, 2019

(30) Foreign Application Priority Data

Jan. 12, 2018 (TW) ..... 107101293

(51) Int. Cl.

| | |
|---|---|
| ***B25B 23/00*** | (2006.01) |
| ***B25B 13/06*** | (2006.01) |
| ***B25B 19/00*** | (2006.01) |
| ***B25B 21/02*** | (2006.01) |

(52) U.S. Cl.

CPC ..... *B25B 23/0035* (2013.01); *B25B 13/06* (2013.01); *B25B 19/00* (2013.01); *B25B 21/02* (2013.01)

(58) Field of Classification Search

CPC ..... B25B 23/0035; B25B 13/06; B25B 21/02; B25B 19/00

See application file for complete search history.

(56) References Cited

U.S. PATENT DOCUMENTS 2,559,558 A * 7/1951 Carlson ..... B25B 19/00 173/93.7
2,638,807 A * 5/1953 Sharman ..... B25G 1/005 173/93.7
3,054,312 A * 9/1962 Zengerer ..... B25B 19/00 173/93.7
3,366,187 A * 1/1968 Von Tersch ..... B25B 19/00 173/93.6
4,561,507 A * 12/1985 Liou ..... B25B 15/06 173/93
4,745,980 A * 5/1988 Chung ..... B25B 19/00 173/111
6,814,159 B1 * 11/2004 Huang ..... B25B 19/00 173/121

(Continued)

FOREIGN PATENT DOCUMENTS

TW M446683 U 2/2013
TW M463173 U 10/2013

*Primary Examiner* — David B. Thomas

(74) *Attorney, Agent, or Firm* — Alan D. Kamrath; Karin L. Williams; Mayer & Williams PC

(57) ABSTRACT

The present disclosure provides an impact wrench for detaching bolts or nuts together with socket. The impact wrench includes a pole, a driving member, an elastic member, and a connecting portion. The driving member is slidably and rotatably disposed to one end of the pole. The other end of the pole has a sleeving portion which may be a rectangular hole. The elastic member presses against the driving member and the pole to make the driving member continuously moving away from the sleeving portion. The connecting portion is configured on the pole or on the driving member. The connecting portion is adapted for a handle to be assembled thereon. Therefore, power tool may be attached to the sleeving portion to provide rotational impulse to detach bolts or nuts. User may hole the impact wrench by a handle which is assembled on the connecting portion, achieving convenience and safety operation condition.

7 Claims, 10 Drawing Sheets

(56) References Cited

U.S. PATENT DOCUMENTS

| | | | | |
|---|---|---|---|---|
| 7,051,628 | B2 * | 5/2006 | Wilson | B25B 19/00 173/93.7 |
| 9,073,182 | B2 * | 7/2015 | Liou | B25D 16/00 |

* cited by examiner

IMPACT WRENCH

RELATED APPLICATIONS

This application claims priority to Taiwan Application Serial Number 107101293, filed on Jan. 12, 2018, which is herein incorporated by reference.

FIELD OF THE INVENTION

The present disclosure relates to an impact wrench, which can be operated together with a socket for detaching or fastening bolts or nuts.

BACKGROUND OF THE INVENTION

There are various hand tools in the market for users to choose from. Among the hand tools, sockets are frequently used for detaching bolts or nuts. Users may utilize a socket to connect a wrench to a bolt, sleeving on the bolt for fastening or detaching the bolt. If the bolt is secured on the work piece for a long period, the bolt is always stuck on the position by the rust or thermal contraction, and the bolt can hardly be detached. If users try to detach the bolt vigorously simply by using socket or wrench, the bolt may be twisted off or be abraded. Removal of the remaining bolt would be disturbing and difficult.

To prevent the mentioned destruction to the bolt, impact wrench, as shown in FIG. 1 and FIG. 2, is provided to the users. The impact wrench mainly includes a pole 11, a driving member 12, and a spring 13. One end of the pole 11 is configured with an opening 14 and a slant groove 15. The driving member 12 is received in the opening 14, being slidably disposed to the slant groove 15 by a pin 16 disposed thereon. The spring 13 is received in the opening 14, pushing against the pole 11 and the driving member 12. Therefore, the distal end of the driving member 12 can be inserted into the socket 17 to be connected to the bolts/nuts. User may hold the pole 11 by one hand, vertically striking the distal end of the pole 11 with a hammer by the other hand. The shock caused by the striking will be transmitted to the bolts/nuts via the pole 11, the pin 16, the driving member 12, and the socket 17. Intense vibration is then induced on the bolts/nuts, helping loosening the bolts/nuts. In the meanwhile, the striking leads compression of the spring 13, causing sliding of the driving member 12 along the slant groove 15. The driving member 12 is then rotated to rotate the socket 17 and the bolts/nuts. In the end, the bolts/nuts can be detached by the rotation and vibration caused by the striking on the pole 11.

The impact wrench mentioned above may help in detaching bolts/nuts with the rotation and vibration induced in hammer striking, however, some inconvenience still exists in the operation process and condition. First, the impact wrench can work only with a hammer or the like. Power tool, such as pneumatic wrench, cannot mate with the impact wrench to improve the work efficiency. Secondly, the impact wrench needs to be hold by hand. The shock induced by the striking can also be transmitted to the user's hand, making the user uncomfortable. Moreover, a careless user may strike on the hand with the hammer. Occupational injury may occur in using the impact wrench.

The present invention is, therefore, arisen to obviate or at least mitigate the above mentioned disadvantages.

SUMMARY OF THE INVENTION

One of the objects of the present invention is to provide an impact wrench which can be operated easily to diminish the opportunity of the injury caused to the user.

To achieve the above and other objects, an impact wrench of the present invention includes a pole, a driving member, an elastic member, and a connecting portion. The pole has a first distal portion and a second distal portion. The first distal portion has a sleeving portion. The driving member is slidably and rotatably disposed to the second distal portion. The driving member rotates about the pole when the driving member slides along the pole. The driving member has a driving portion which extends away from the first distal portion along the pole. The elastic member presses against the pole and the driving member, leading a potential of position recovery of the driving member to move away from the first distal portion. The connecting portion is configured on one of the pole and the driving member. The connecting member is adapted for a handle to be assemble thereon.

In some embodiments, the sleeving portion can be a rectangular hole.

In some embodiments, the connecting portion can be a polygonal prism or a hexagonal prism. The connecting portion can be formed on the pole, locating between the first distal portion and the driving member.

In some embodiments, the connecting portion may have an outline larger than that of the first distal portion.

In some embodiments, the connecting portion is configured as a pivoting hole. The impact wrench further includes a handle which is pivoted to the connecting portion.

The present invention will become more obvious from the following description when taken in connection with the accompanying drawings, which show, for purpose of illustrations only, the preferred embodiment(s) in accordance with the present invention.

BRIEF DESCRIPTION OF THE DRAWINGS

The present disclosure can be more fully understood by reading the following detailed description of the embodiment, with reference made to the accompanying drawings as follows.

DETAILED DESCRIPTION OF THE PREFERRED EMBODIMENTS

Figure 1:
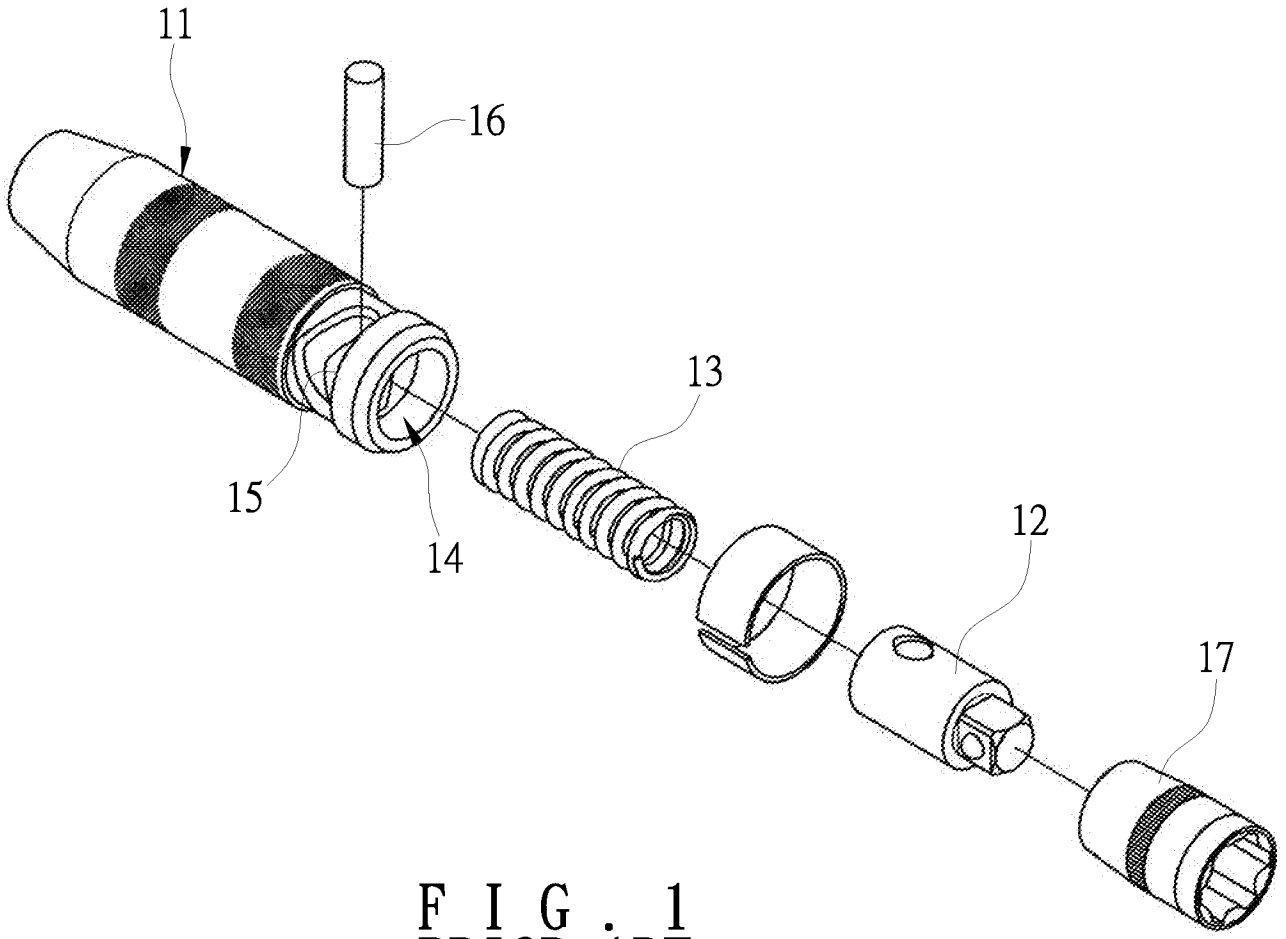
FIG. 1 PRIOR ART
FIG. 1 is a breakdown drawing showing the conventional impact wrench.
Figure 2:
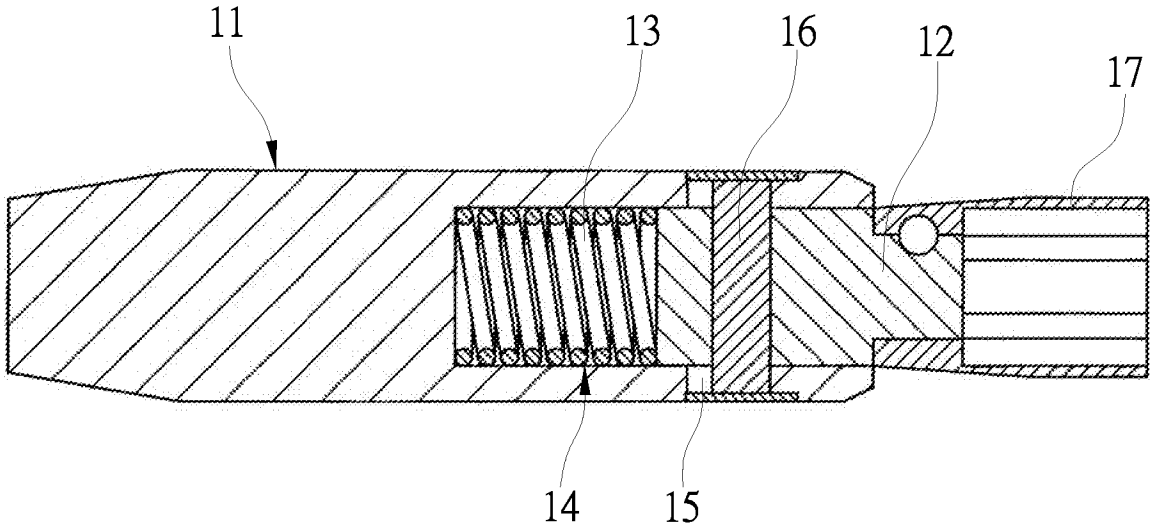
FIG. 2 PRIOR ART
FIG. 2 is profile showing the conventional impact wrench.
Figure 3:
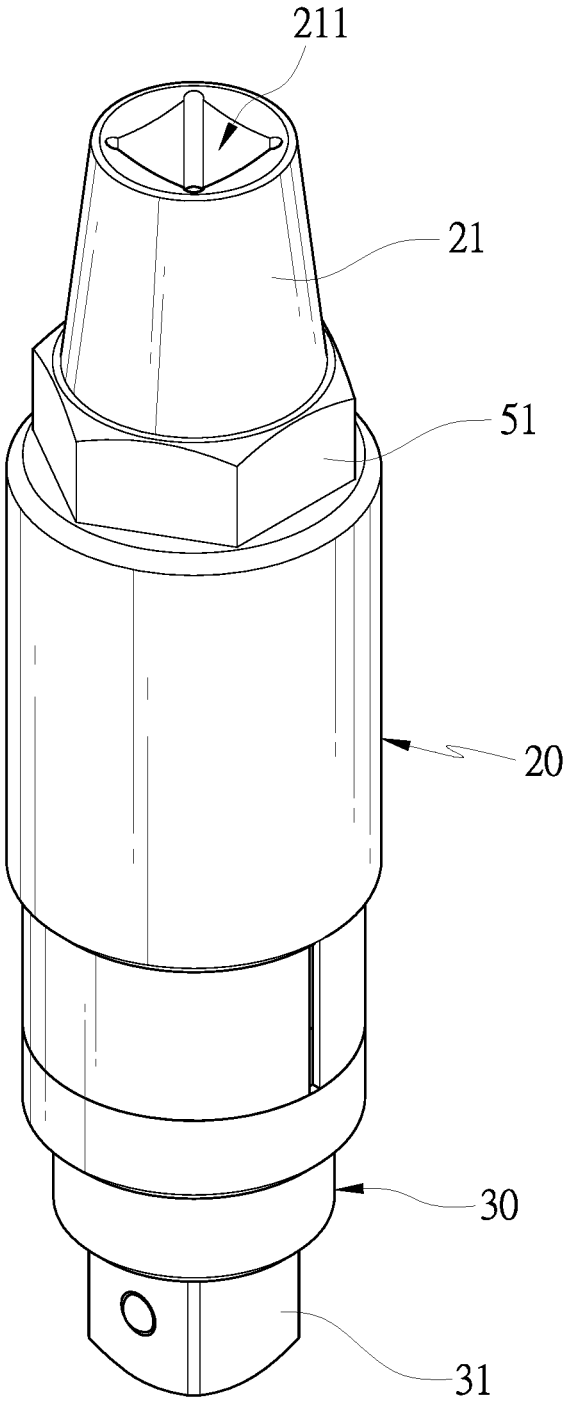
FIG. 3 is a stereogram showing a first embodiment of the present invention.
Figure 4:
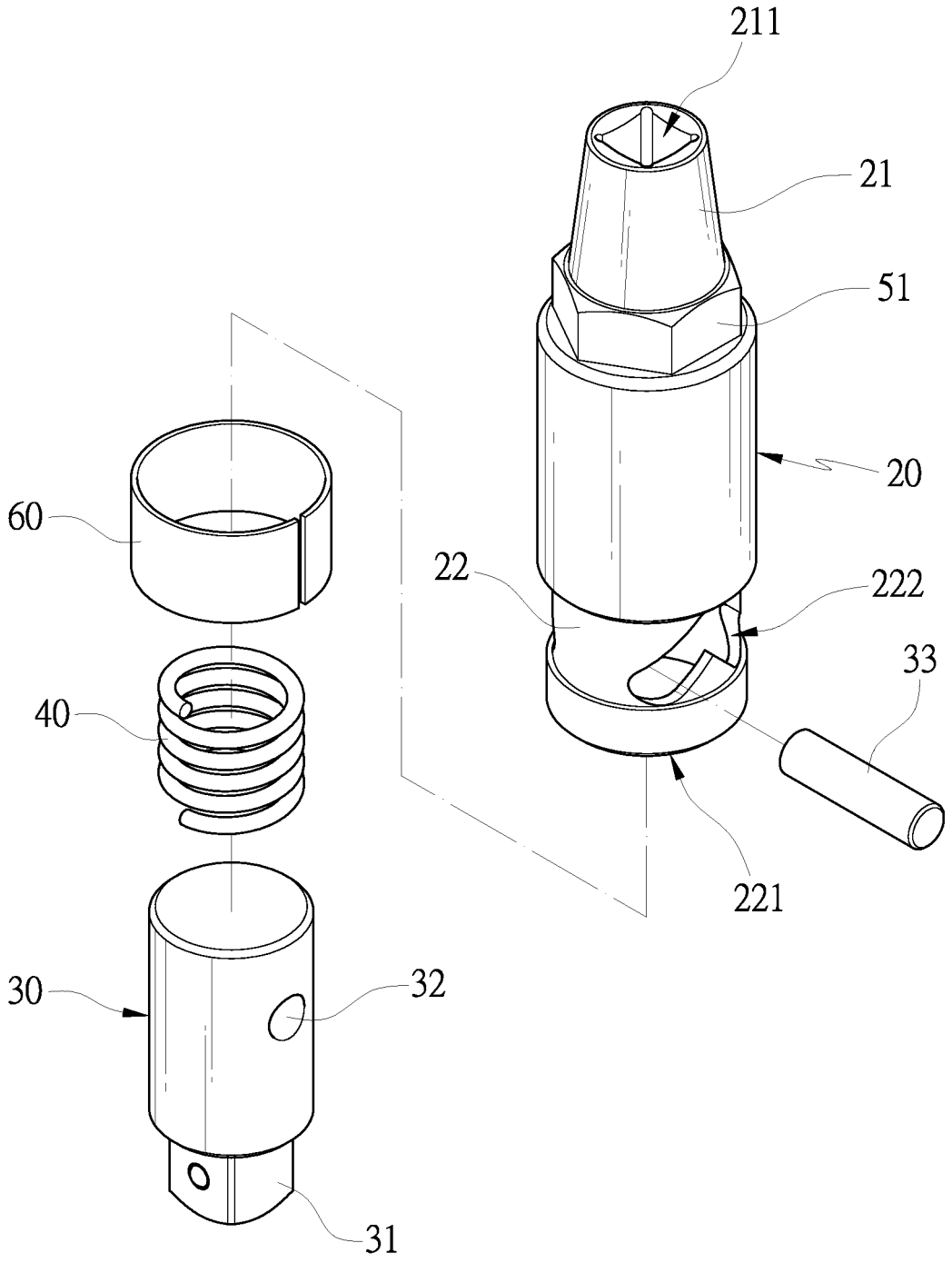
FIG. 4 is a breakdown drawing showing a first embodiment of the present invention.
Figure 5:
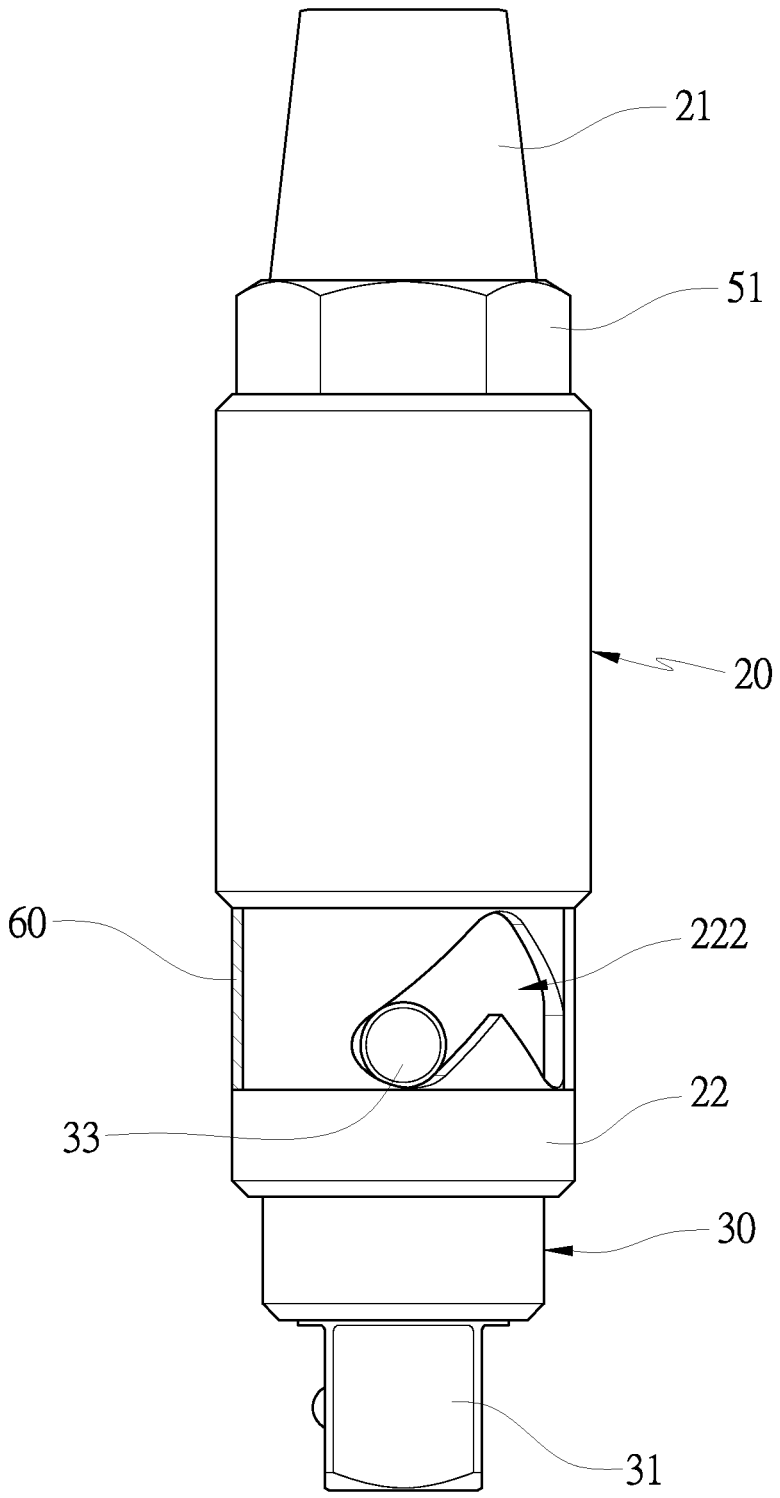
FIG. 5 is a partial sectional drawing showing a first embodiment of the present invention.
Figure 6:
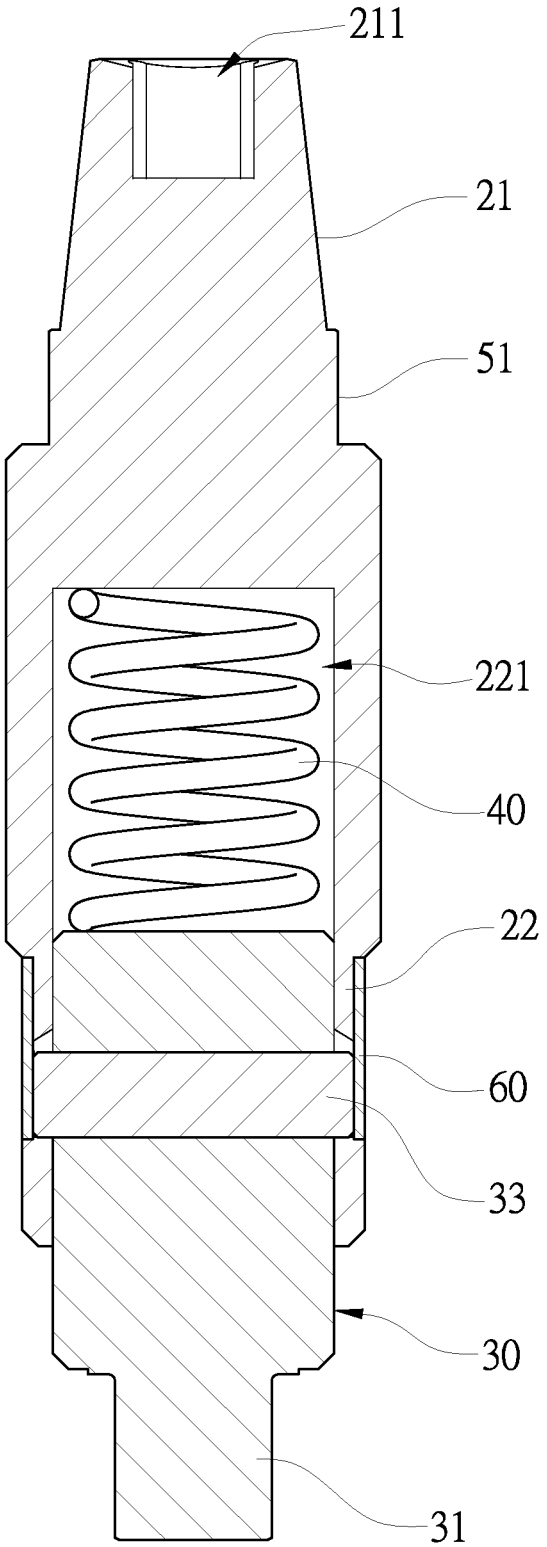
FIG. 6 is a full section view showing a first embodiment of the present invention.

Please refer to FIG. 3 to FIG. 6, the present embodiment reveals an impact wrench. The impact wrench is capable of detaching bolts/nuts by transmitting shock and rotation to the bolts/nuts so as to prevent the bolts/nuts from being teared, abraded, or destroyed when the bolts/nuts are stuck. The impact wrench includes a pole 20, a driving member 30, an elastic member 40, and a connecting portion 51. The impact wrench may further include a ligature 60.

The pole 20 has a first distal portion 21 and a second distal portion 22. The first distal portion 21 has a sleeving portion. In the present embodiment, the sleeving portion is a rectangular hole 211. The second distal portion 22 has an axial hole 221 and two slant grooves 222. The slant grooves 222 are configured as V-shaped grooves, being non-parallel to the pole 20. The cusps of the slant grooves 222 are aiming toward the first distal portion 21. The slant grooves 222 are concaved from outer surface of two opposite lateral sides of the pole 20, radially communicating with the axial hole 221.

The driving member 30 has a driving portion 31 and a through hole 32. The driving member 30 is partially received in the axial hole 221. The driving portion 31 is exposed beyond the axial hole 221, extending away from the first distal portion 21 along the pole 20. The through hole 32 is located in the axial hole 221 and aligned with the slant grooves 222. The driving member 30 further includes a pin 33. The pin 33 is inserted in the slant grooves 222 and the through hole 32, so that the driving member 30 can slide along the slant grooves 222 with respect to the pole 20. Since the slant grooves 22 are slant with respect to the pole 20, the driving member 30 rotates with respect to the pole 20 when the driving member 30 slides.

The elastic member 40 is received in the axial hole 221. Two ends of the elastic member 40 press against the pole 20 and the driving member 30, making the driving member 30 return to a position away from the first distal portion 21.

The connecting portion 51 is a hexagonal prism formed on the pole 20. The connecting portion 51 is located between the first distal portion 21 and the driving member 30. More particularly, the connecting portion 51 is configured adjacent to the first distal portion 21. The connecting portion 51 has an outline larger than the outline of the first distal portion 21. Therefore, wrench or spanner can be sleeved on or clutch on the connecting portion 51. In other possible embodiments of the present invention, the connecting portion may be disposed on other particular position of the pole 20 or of the driving member 30 unless the movement of the driving member 30 is obstructed.

The ligature 60 is a C-shaped girdle, sleeving on the pole 20 for covering the slant grooves 222. The pin 33 is then held in the slant grooves 22, and is unremovable.

Figure 7:
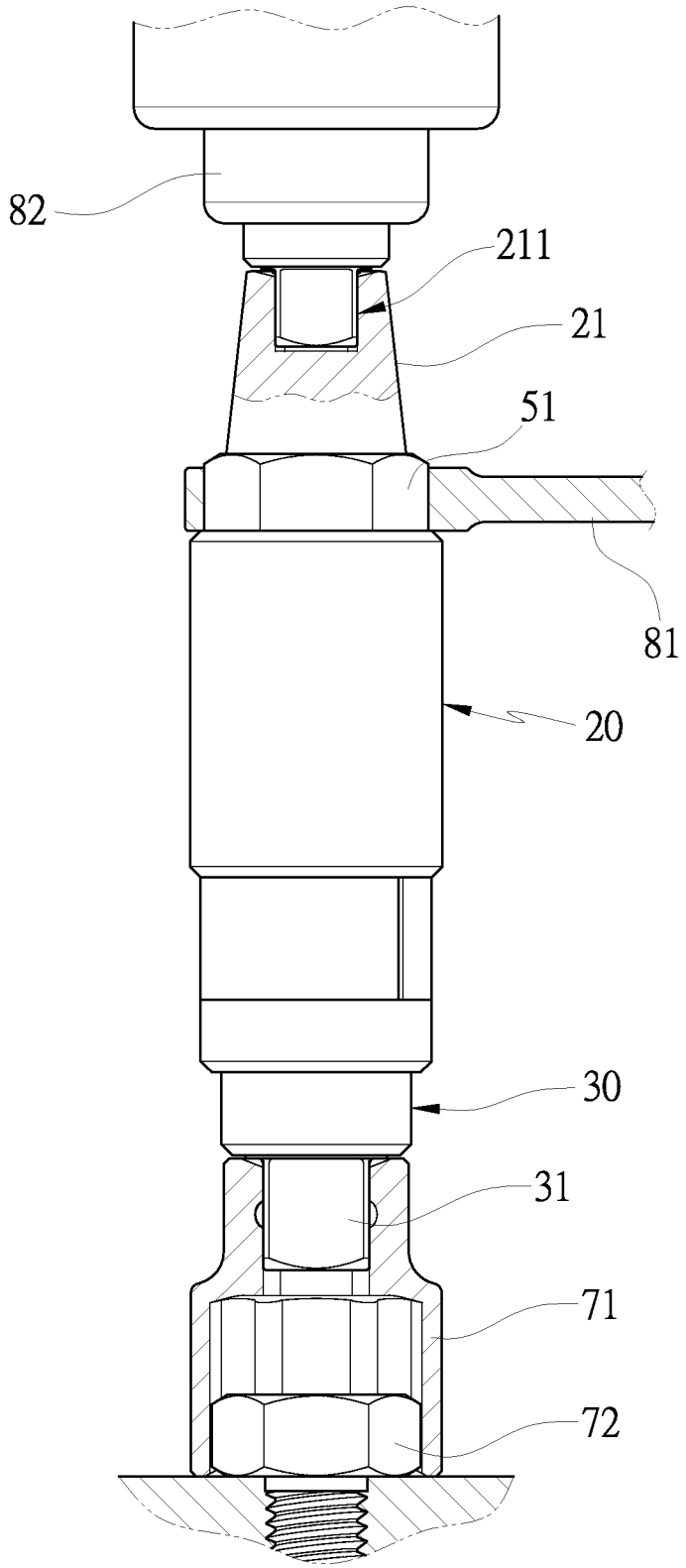
FIG. 7 is lateral profile showing an operation condition of a first embodiment of the present invention.

Please refer to FIG. 7. When the user is going to detach the bolt 72, the socket 71 may firstly be sleeved on the bolt 72. The impact wrench can be attached to the socket 71 by inserting the driving portion 31 into the socket 71. A spanner 81 is sleeved on and attached to the connecting portion 51. Power tool 82, within impact generating function, is inserted in the rectangular hole 211 of the first distal portion 21 of the impact wrench. The spanner 81 may be utilized as a handle. User can hold the spanner 81 to keep the impact wrench in position by one hand, manipulating the power tool 82 by the other hand. The power tool 82 then provides striking pulse to the bolt 72 via the impact wrench and the socket 71. During the transmission of the pulse, the driving member 30 is pressed to slide with respect to the pole 20. Therefore, accompanied with the pulse transmission, the driving member 30 slides and rotates with respect to the pole 20, torqueing the bolt 72 to rotate. After the bolt 72 is shocked and torqued to be loosened, user can detach the bolt 72 easily.

According to the embodiment mentioned, user can detach the bolts/nuts by the impact wrench, holding the impact wrench by a spanner. Directly holding the pole of the impact wrench is not necessary. Uncomfortable or injury caused by the vibration is then diminished. Additionally, the impact wrench may be driven by a power tool 82 for receiving and transmitting shock and vibration. Striking with a hammer which could cause occupational or accidental injury is no longer necessary.

Figure 8:
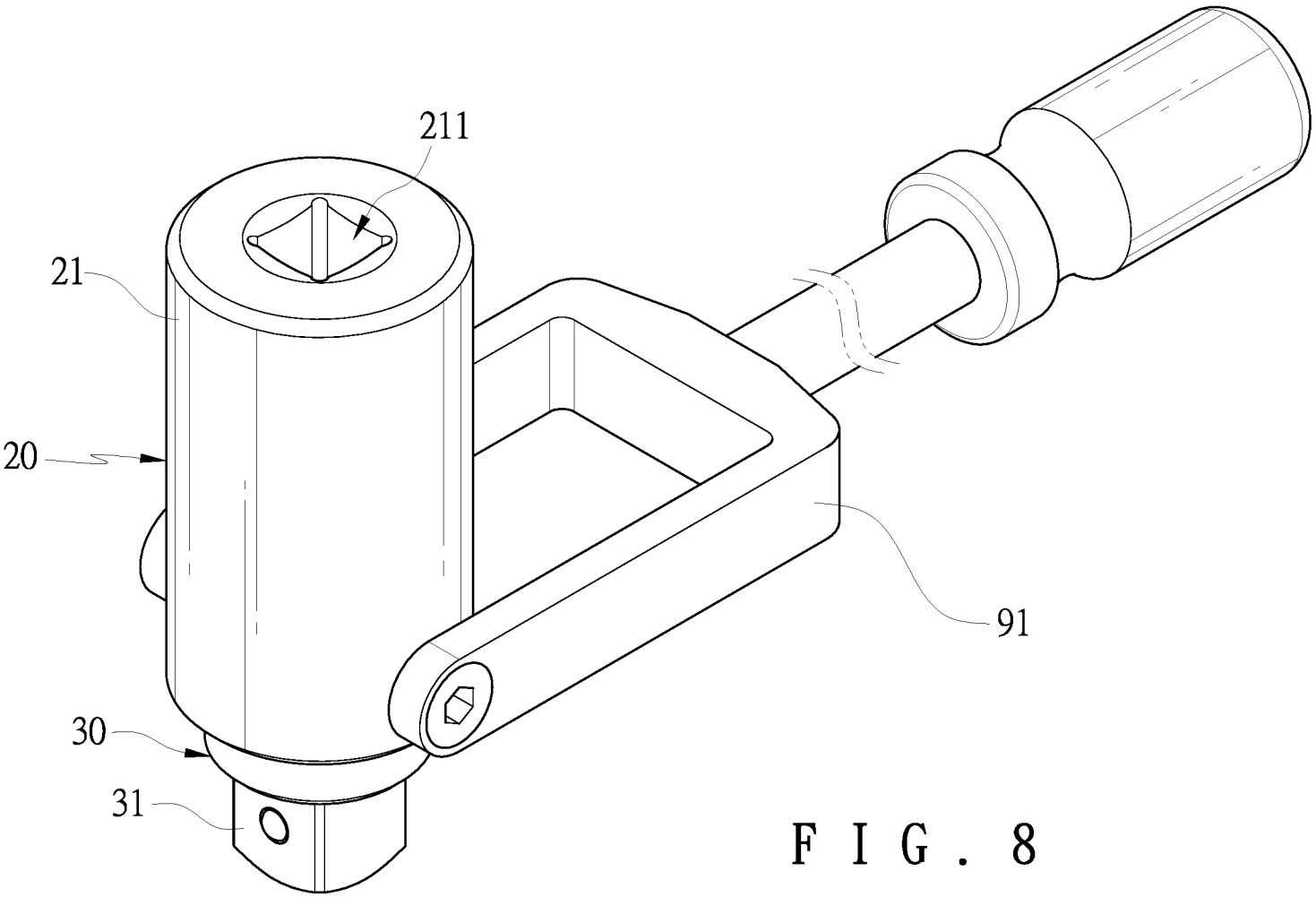
FIG. 8 is a stereogram showing a second embodiment of the present invention.
Figure 9:
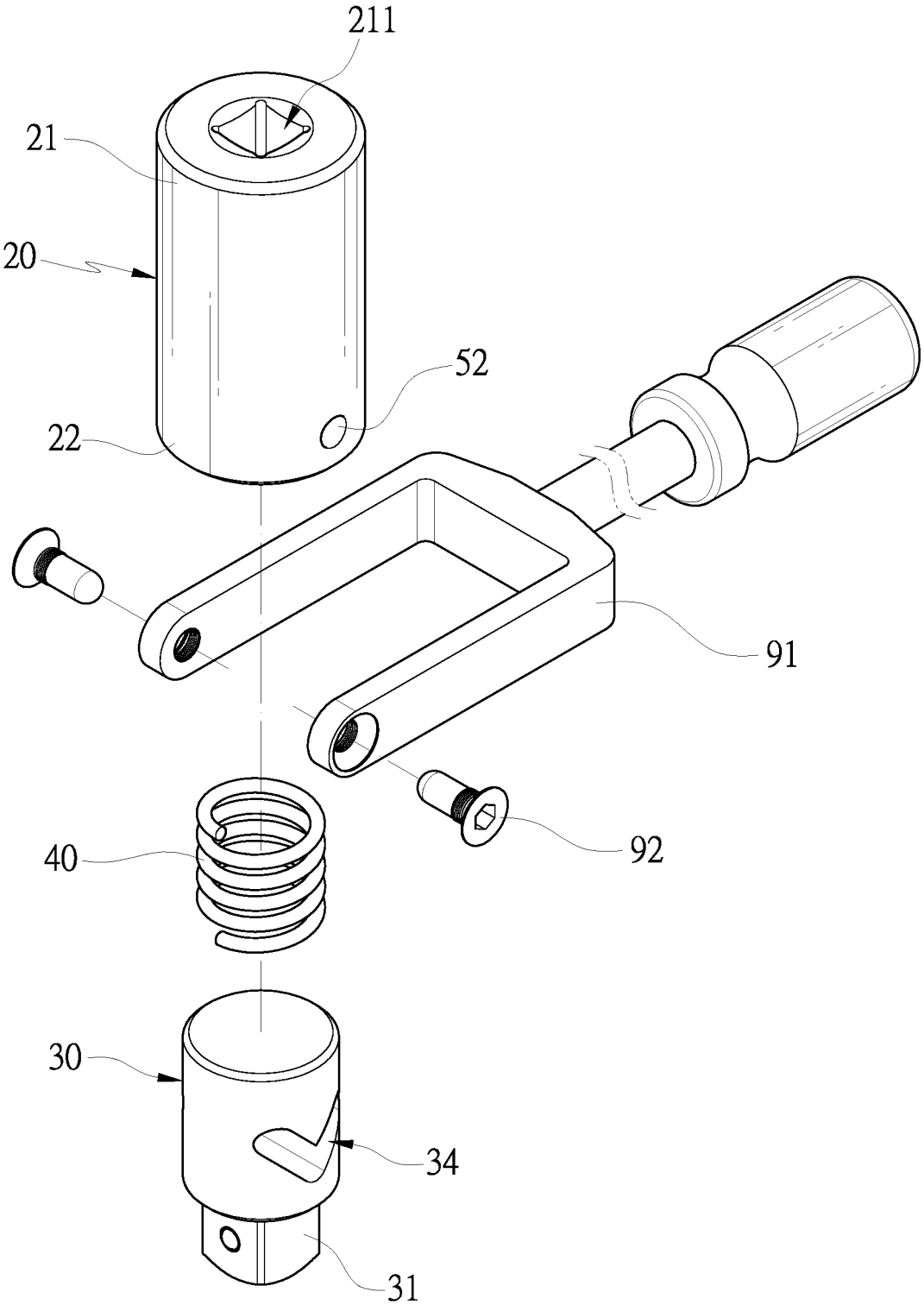
FIG. 9 is a breakdown drawing showing a second embodiment of the present invention.
Figure 10:
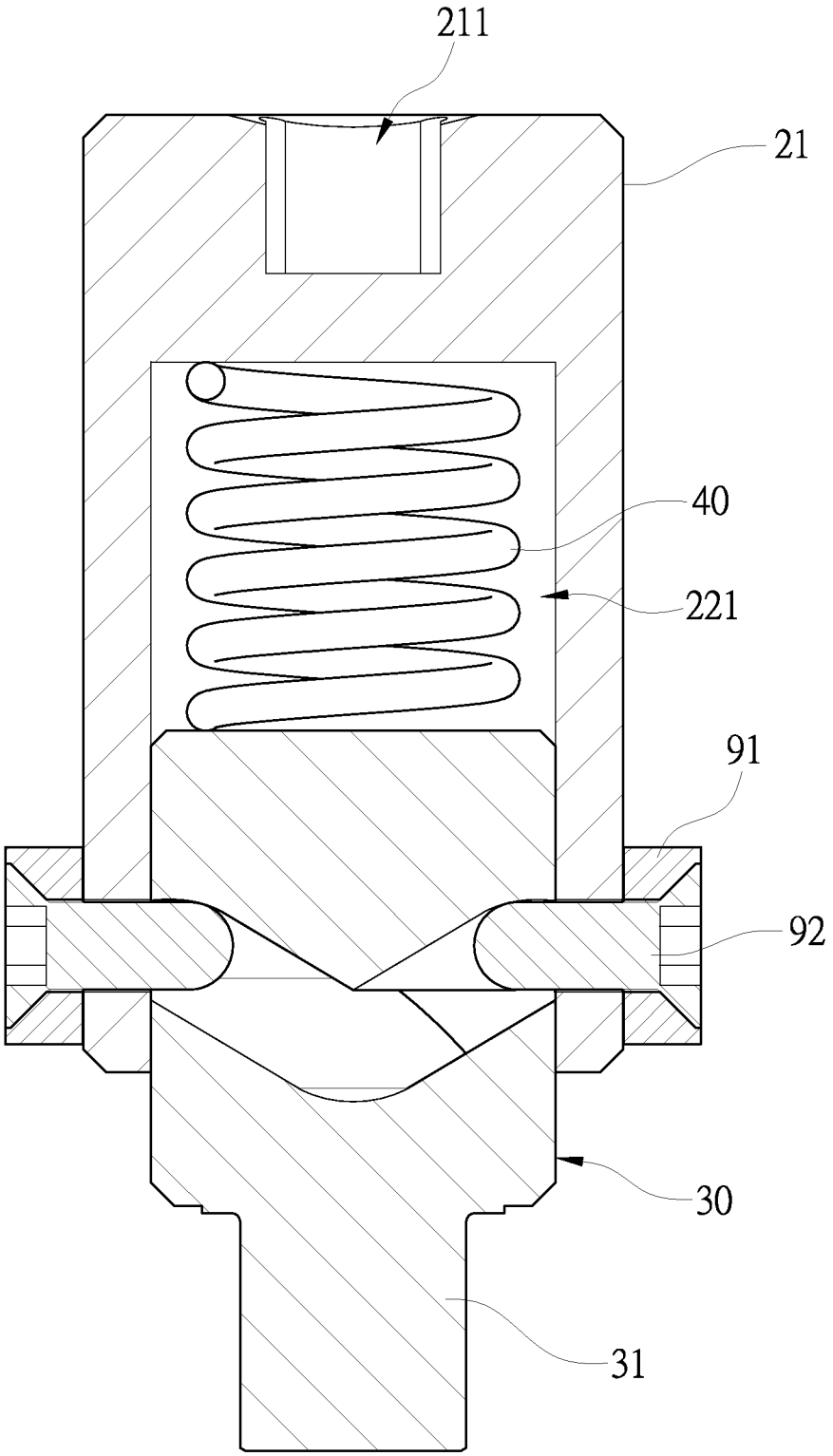
FIG. 10 is a section view showing a second embodiment of the present invention.

Please refer to FIG. 8 to FIG. 10. A second embodiment of the present invention reveals an impact wrench which includes a pole 20, a driving member 30, an elastic member 40, and a connecting portion 52. The impact wrench further includes a handle.

The pole 20 is generally similar to the pole as disclosed in the first embodiment mentioned before. The pole 20 has a first distal portion 21 and a second distal portion 22. The first distal portion 21 has a sleeving portion, which is also a rectangular hole 211 in the embodiment. The second distal portion 22 has an axial hole 221, noted that the second distal portion 22 has no slant grooves.

The driving member 30 has a driving portion 31. The driving member 30 is partially received in the axial hole 221. The driving portion 31 is exposed beyond the axial hole 221, extending away from the first distal portion 21 along the pole 20. The driving member 30 has a slant groove 34. The slant groove 34 is configured as a V-shaped groove, being non-parallel to the pole 20. The cusp of the slant groove 34 is aiming away from the first distal portion 21.

The elastic member 40 is general similar to the elastic member as disclosed in the first embodiment mentioned before. The elastic member 40 is received in the axial hole 221, pushing the driving member 30 to return to a position away from the first distal portion 21.

The connecting portion 52 is a pivoting hole, which is formed on the pole 20 and penetrates the pole 20. The connecting portion 52 is aligned with the slant groove 34.

The handle includes a lever 91 and two pivot pins 92. The lever 91 is pivoted to the connecting portion 52 by the pivot pins 92. More particularly, the pivot pins 92 is screwed on the lever 91, and is rotatably inserted in the connecting portion 52 and in the slant groove 34. Therefore, the connecting portion 52 is formed on the pole 20, the lever 91 is pivoted to the pole 20, and the driving member 30 is slidably and rotatably disposed to the pole 20.

The operational condition of the impact wrench of the second embodiment is generally similar to the operation of the impact wrench of the first embodiment mentioned. The impact wrench may connect a power tool to a socket, and further to the bolt to be detached. User may hold the impact wrench by the lever of the handle thereof. Additional spanner for holding the impact wrench is then dismissed.

In view of the above mention embodiments, the impact wrenches are suitable for connecting power tool to socket to detach bolts/nuts. User can hold the impact wrench by a spanner or by the handle. hammer Striking is abandoned to reduce the opportunities of occupational or accidental injury. Safety and conveniency of the impact wrench are then improved.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An impact wrench, comprising:

a pole, having a first distal portion and a second distal portion, the first distal portion having a sleeving portion;

a driving member, slidably and rotatably disposed to the second distal portion, the driving member rotating about the pole when the driving member slides along the pole, the driving member having a driving portion, the driving portion extending away from the first distal portion along the pole;

an elastic member, pressing against the pole and the driving member, leading a potential of position recovery of the driving member to move away from the first distal portion; and a connecting portion, configured on one of the pole and the driving member, the connecting member being adapted for a handle to be assemble thereon, wherein the connecting portion is a polygonal prism, and the connecting portion is formed on the pole.

2. The impact wrench of claim 1, wherein the connecting portion is a hexagonal prism, and the connecting portion is formed between the first distal portion and the driving member.

3. The impact wrench of claim 2, wherein, the connecting portion has an outline larger than an outline of the first distal portion.

4. The impact wrench of claim 1, wherein the sleeving portion is a rectangular hole.

5. The impact wrench of claim 4, wherein the connecting portion is a hexagonal prism, and the connecting portion is formed between the first distal portion and the driving member.

6. The impact wrench of claim 5, wherein, the connecting portion has an outline larger than an outline of the first distal portion.

7. An impact wrench, comprising:

a pole, having a first distal portion and a second distal portion, the first distal portion having a sleeving portion;

a driving member, slidably and rotatably disposed to the second distal portion, the driving member rotating about the pole when the driving member slides along the pole, the driving member having a driving portion, the driving portion extending away from the first distal portion along the pole;

an elastic member, pressing against the pole and the driving member, leading a potential of position recovery of the driving member to move away from the first distal portion; and a connecting portion, configured on one of the pole and the driving member, the connecting member being adapted for a handle to be assemble thereon, wherein the sleeving portion is a rectangular hole.

* * * * *